US006787182B2

(12) United States Patent
Taguchi et al.

(10) Patent No.: US 6,787,182 B2
(45) Date of Patent: Sep. 7, 2004

(54) RESISTOR AND METHOD FOR PRODUCING THE RESISTOR

(75) Inventors: Yoshihiro Taguchi, Miyagi-ken (JP); Shunetsu Satou, Miyagi-ken (JP)

(73) Assignee: Alps Electrics, Co., Ltd., Tokyo (JP)

( * ) Notice: Subject to any disclaimer, the term of this patent is extended or adjusted under 35 U.S.C. 154(b) by 0 days.

(21) Appl. No.: 10/411,723

(22) Filed: Apr. 11, 2003

(65) Prior Publication Data

US 2003/0197589 A1 Oct. 23, 2003

(30) Foreign Application Priority Data

Apr. 19, 2002 (JP) ..... 2002-116956

(51) Int. Cl.[7] ..... B05D 5/12; H01C 17/00

(52) U.S. Cl. ..... 427/101; 427/102; 29/610.1; 29/620

(58) Field of Search ..... 427/101, 102; 29/610.1, 620

(56) References Cited

U.S. PATENT DOCUMENTS 6,083,426 A * 7/2000 Shimasaki et al. ..... 252/500
6,172,595 B1 1/2001 Komatsu et al.

FOREIGN PATENT DOCUMENTS

RU 894800 * 12/1981

* cited by examiner

*Primary Examiner*—Brian K. Talbot
(74) *Attorney, Agent, or Firm*—Beyer Weaver & Thomas, LLP

(57) ABSTRACT

A method for producing a resistor. The method includes a process for printing, in a prescribed pattern, a mixed solution containing a good solvent having solubility to a binder good solvent, a thermosetting binder resin, and a conductive filler. The method further includes a process for driving the mixed solution: and a process for curing the binder resin by baking. The good solvent is at least one selected from dipropylene glycol monomethyl ether, diethylene glycol monomethyl ether, and dipropylene glycol monoethyl ether. The poor solvent is at least one selected from terpineol eat 2-phenoxy ethanol and 2-benzyloxy ethanol.

2 Claims, 8 Drawing Sheets

RESISTOR AND METHOD FOR PRODUCING THE RESISTOR

BACKGROUND OF THE INVENTION

1. Field of the Invention

The present invention relates to a resistor used for a variable resistor, a switch and other electronic input devices, and it particularly has an object to provide a resistor capable of minimizing the contact resistance of the surface of the resistor with a sliding contact or contact member, and a method for producing the resistor.

2 Description of the Related Art

A resistor used for a variable resistor, a switch contact or the like is formed as film on a substrate in a prescribed thickness. To produce this resistor, a mixed solution of a thermosetting binder resin, a solvent for dissolving the binder resin, and a conductive filler such as carbon black is applied onto the surface of the substrate by means of screen printing or the like. The solvent is vaporized in a drying process followed by baking to cure the binder resin.

The resistance characteristic of the above-mentioned resistor is determined depending on the quantity of the filler in the binder resin which forms the resistor, and also influenced by the dispersion state of the conductive filler in the binder resin. In resistors formed in the same pattern, the lower the total resistance value is, the larger the content of the filler is. In resistors containing the same amount of conductive filler, the larger the total resistance value is, the higher the dispersity of the filler is in the binder resin. Namely, when the dispersity of the conductive filler is high, current paths are dispersed among conductive fillers to increase the resistance value as the whole. When the part where the conductive filler is collectively aggregated is increased in the binder resin, the current paths are easily formed in the resistor, resulting in a reduction in the total resistance value.

In an electronic input device in which a sliding contact is slid on the surface of the resistor or a contact member is brought into contact therewith, when the total resistance value of the resistor is large, the contact resistance value of the resistor with the sliding contact or contact member is increased by just that much, and the portion of the contact resistance value is consequently added to the resistance value set by the resistor as a large error.

If the total resistance value of the resistor is not set large in the constitution of a small-sized slide type variable resistor having high resolution, for example, the change quantity of resistance value is minimized when the sliding contact is moved by a short distance, and the range between maximum resistance value and minimum resistance value obtained from the variable resistor is also minimized, so that the high resolution cannot be ensured. However, since the contact resistance is increased when the total resistance of the resistor of the variable resistor is set high as above, the ratio of the error portion by the contact resistance to the resistance value set by the movement of the sliding contact is increased to make it difficult to precisely set the correspondence of the moving position of the sliding contact to the resistance value corresponding thereto.

When the total resistance value of the resistor is reversely reduced to reduce the contact resistance, the range between maximum resistance value and minimum resistance value is too small to obtain sufficient resolution in a small-sized variable resistor.

SUMMARY OF THE INVENTION

To solve the conventional problems described above, the present invention has an object to provide a resistor cable of minimizing the contact resistance with a sliding contact or contact member without significantly reducing the total resistance value by making the resistance in the surface of the resistor smaller than the resistance in the inner part thereof, and a method for producing this resistor.

The present invention involves a resistor formed of a conductive resin material comprising a binder resin and a conductive filler mixed to the binder resin, wherein when compared between a surface of the resistor and an internal cross section parallel to the surface of the resistor on the basis of regions partitioned in the same area, dispersity of the conductive filler in the binder resin is lower in the surface than in the cross section.

In this specification, the degree of dispersity of the conductive filler can be defined as follows.

Firstly, when compared on the basis of the partitioned regions, the one having a larger maximum dimension of two or more aggregates of the conductive filler is defined as the one having low dispersity. According to this definition, the maximum dimension of the aggregates of the conductive filler is larger in the surface than in the cross section of the resistor.

Secondarily, when compared on the basis of the partitioned regions, the one having a larger maximum diameter of two or more virtual circles drawable in a part free from the conductive filler is defined as the one having low dispersity. According to this definition, the maximum diameter of the virtual circles is larger in the surface than in the cross section of the resistor.

The method for producing a resistor according to the present invention comprises:

a process for printing, in a prescribed pattern, a mixed solution containing a good solvent with high solubility to a binder resin, a poor solvent lower in solubility than the good solvent and also lower in volatility than the good solvent, a thermosetting binder resin, and a conductive filler;

a process for drying the mixed solution; and a process for curing the binder resin by baking.

In the mixed use of the good solvent and the poor solvent, the poor solvent is dominant in the surface of the resistor because the good solvent is vaporized first. Therefore, in the baked resistor, the dispersity of the conductive filler can be reduced in the surface to reduce the contact resistance with the sliding contact or contact member. Since the good solvent and the poor solvent are hardly vaporized in the inner part of the resistor, and present therein for a long time, the dispersity of the conductive filler is enhanced. Accordingly, in the baked resistor, the internal resistance can be increased to increase the total resistance value of the resistor.

To that end, a boiling point of the poor solvent is preferably higher than the boiling point of the good solvent, and a difference between both the boiling points is preferably 15° C. or higher and 30° C. or lower.

In order to make the poor solvent dominant in the surface of the resistor at the time of drying as described above, the drying process is preferably carried out at a temperature higher than the boiling point of the good solvent and lower than the boiling point of the poor solvent.

The good solvent is, for example, at least one or more of dipropylene glycol monomethyl ether, diethylene glycol monomethyl ether, diethylene glycol monoethyl ether, and dipropylene glycol monoethyl ether, and the poor solvent is at least one or more of terpineol, 2-phenoxy ethanol, and 2-benzyloxy ethanol.

BRIEF DESCRIPTION OF THE DRAWINGS

FIG. 1 show a resistor according to a preferred embodiment and working example of the present invention, wherein

FIG. 5 show a resistor according to a comparative example, wherein

DESCRIPTION OF THE PREFERRED EMBODIMENTS

The resistor according to the present invention has a prescribed resistance value and an electronic input device using this resistor is constituted as a one in which a sliding contact or contact member makes contact with the resistor. In a device using the sliding contact, the resistance value corresponding to the position from the end part of the resistor to the sliding contact is variably set by sliding the sliding contact on the resistor formed in a rectangular pattern or ring-like pattern. In a device using the contact member, the resistor has a prescribed resistance value, and the set resistance value of the resistor is read when the contact member makes contact therewith.

Figure 8:
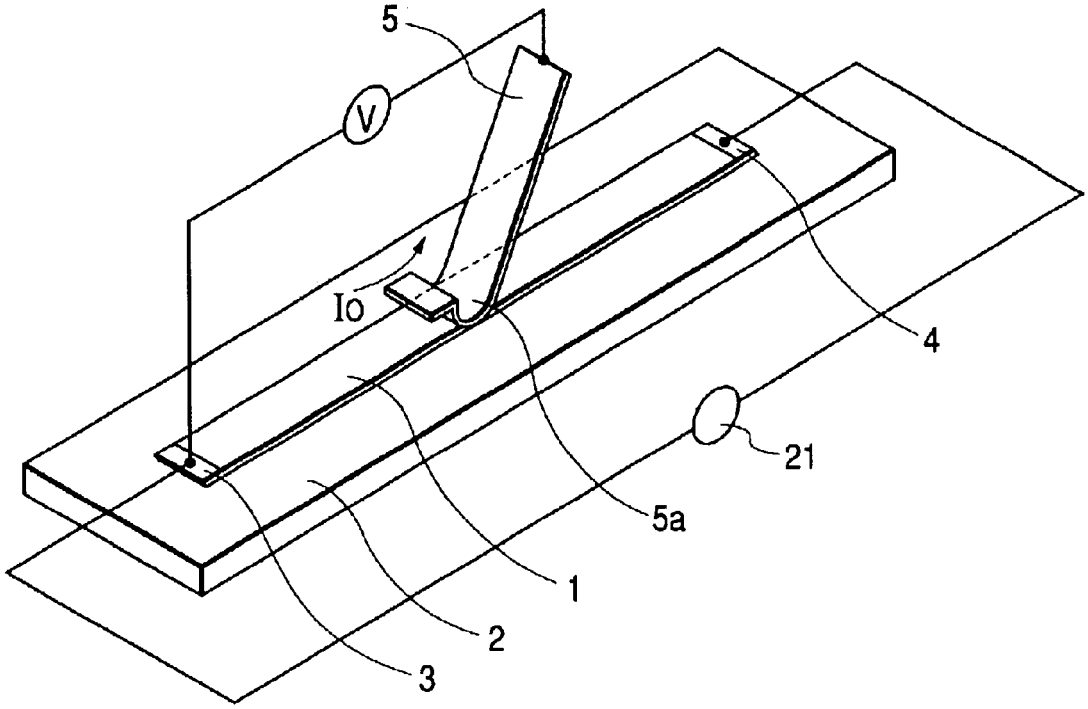
FIG. 8 is a structural view of a variable resistor using the resistor according to the present invention.

FIG. 8 is a perspective view showing a linear type variable resistor as one example of an electronic input device to which a resistor as an embodiment of the present invention is applied.

The resistor 1 is formed on the surface of a substrate 2. The resistor 1 has a strip shape having a prescribed thickness and a fixed width dimension. Electrodes 3 and 4 formed of a conductive material smaller in specific resistance than the resistor 1 are conductively provided on both end parts located in the vertical (longitudinal) direction of the resistor 1. A sliding contact 5 is in contact with the surface of the resistor 1.

The sliding contact 5 is formed of, for example, a phosphor bronze plate having a silver-plated surface, the specific resistance of which is smaller than the resistor 1. The contact part 5*a* of the sliding contact 5 is circularly bent, and the contact part 5*a* is vertically (longitudinally) slid on the surface of the resistor in the state where it is in contact with the surface of the resistor 1. The set values of the sliding contact 5 with the electrodes 3, 4 are changed according to the moving position of the sliding contact 5.

Figure 1A:
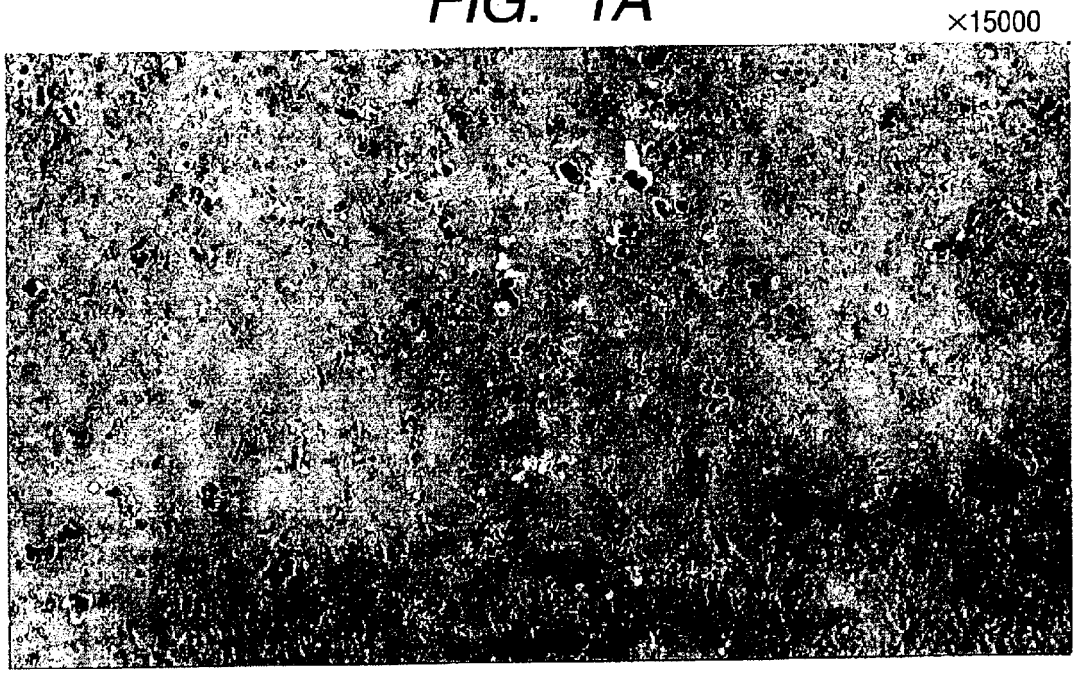
FIG. 1A is a TEM picture of the surface of the resistor.
Figure 1B:
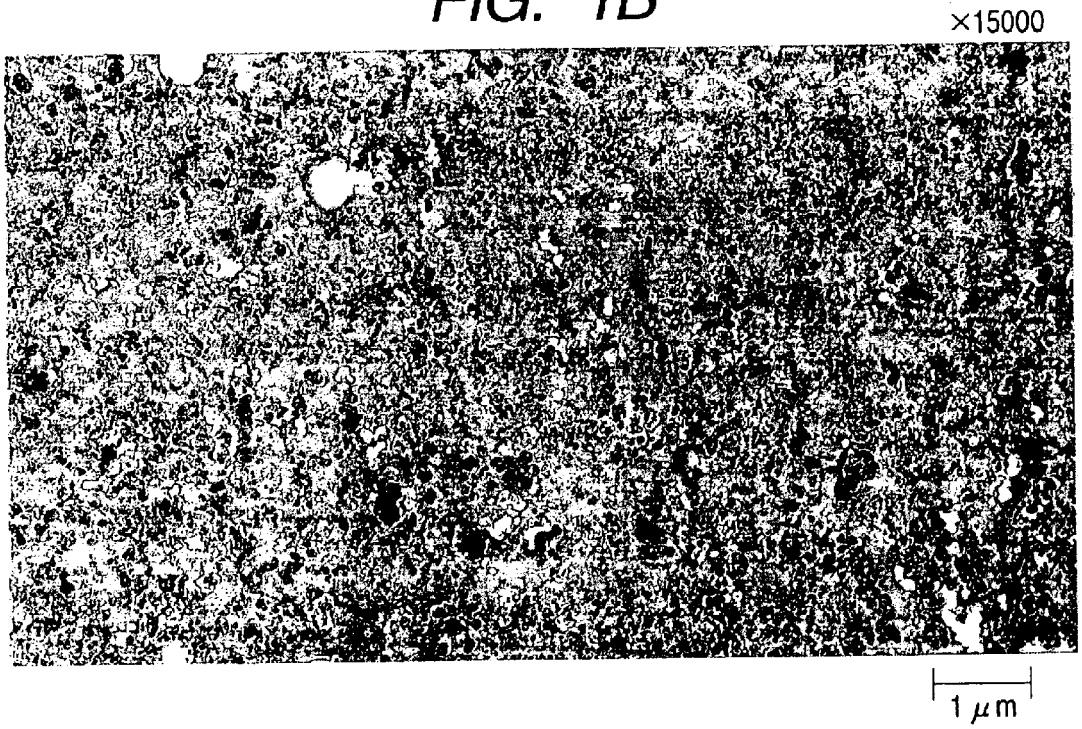
FIG. 1B is a TEM picture of an internal cross section of the resistor.
Figure 2A:
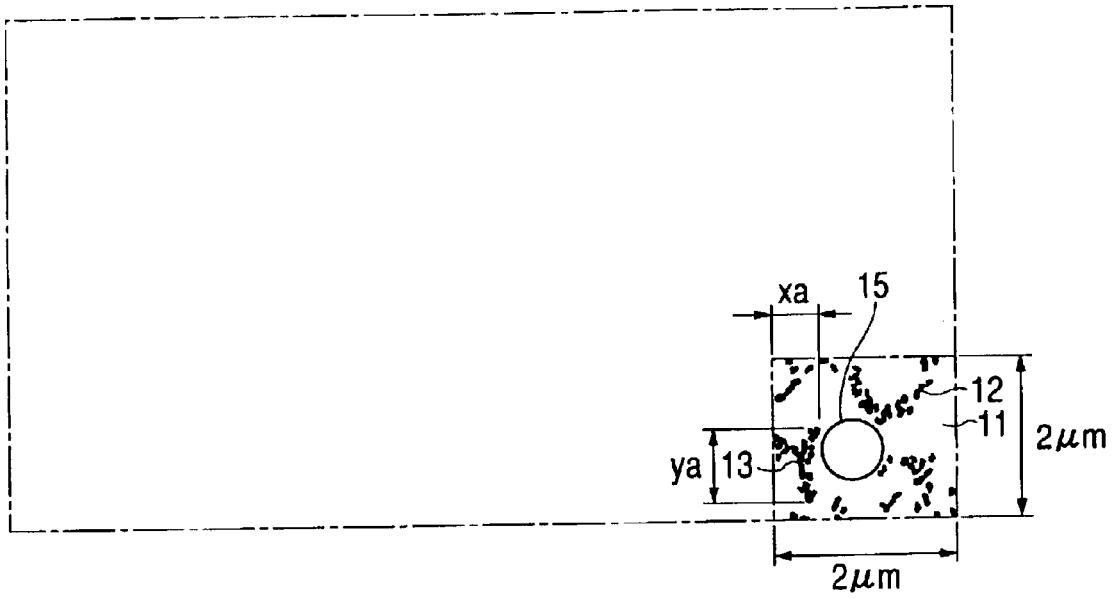
FIGS. 2A and 2B are schematic views in the transfer of the TEM pictures of FIGS. 1A and 1B.
Figure 2B:
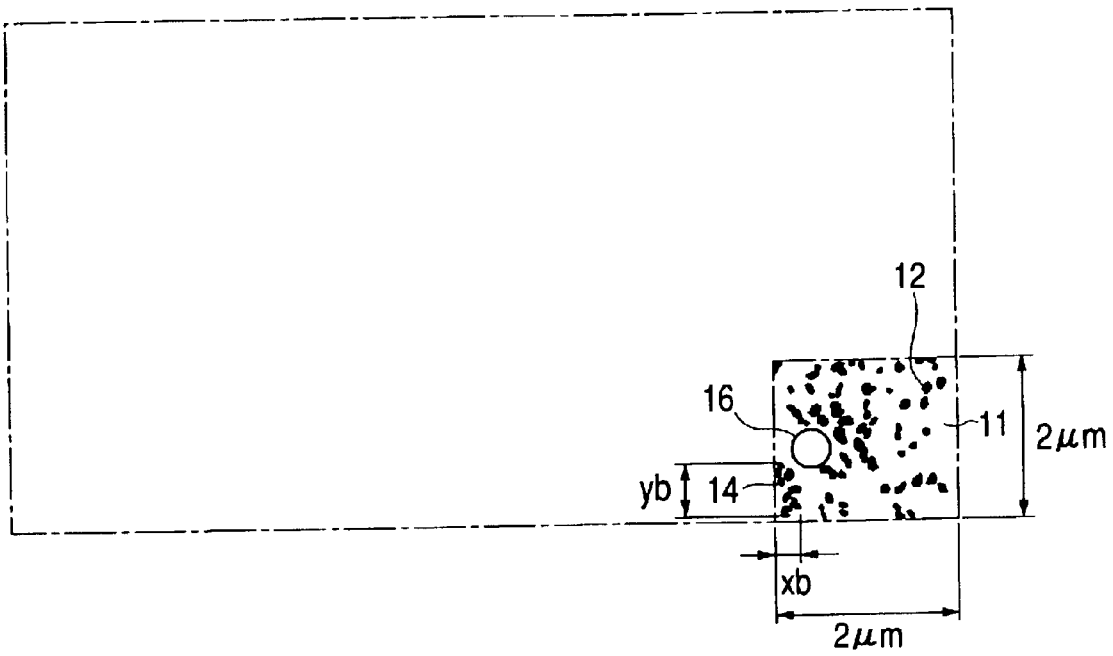

FIG. 1A is a TEM (transmission electron microscopic) picture of the surface of the resistor 1, and FIG. 1B is a TEM picture of an internal cross section parallel to the surface of the resistor. FIG. 2A is a schematic view of the transferred dispersion state of the conductive filler in a 2 $\mu$m×2 $\mu$m partitioned region at the right lower angle part in the TEM picture of FIG. 1A. FIG. 2B is similarly a schematic view of the transferred dispersion state of the conductive filler in a 2 $\mu$m×2 $\mu$m partitioned region at the right lower angle part in the TEM picture of FIG. 1B.

In the resistor 1 shown in the TEM pictures of FIGS. 1A and B, the binder resin is cured in the state where the conductive filler is contained in the binder resin. The binder resin is a thermosetting resin, including, for example, a polyimide resin (hereinafter referred to as resin). The conductive filler of the resistor shown in FIG. 1 is carbon black, and the resin is mixed with the carbon black in a mass ratio of 85:15.

The resistor 1 shown in the TEM pictures of FIGS. 1A and B has a film thickness of 10 $\mu$m. As described above, FIG. 1A shows the surface of the resistor, and the cross section of FIG. 1B is located 0.2 $\mu$m inward from the surface.

Compared between FIGS. 1A and B and FIGS. 2A and B, the dispersion state of the carbon black 12 within the resin 11 is differed, and the carbon black 12 is dispersed more uniformly in the cross section of the resistor 1 than in the surface with the higher dispersity.

In this specification, the degree of dispersity of the carbon black 12 (conductive filler) is defined as follows.

Firstly, when compared on the basis of the partitioned regions, the one having the larger maximum dimension of two or more aggregates of carbon black is defined as the one having low dispersity. According to this definition, the maximum dimension of the aggregates is larger in the surface than in the cross section. In FIG. 2A, the largest aggregate of the carbon black 12 in the partitioned region is denoted at 13, and in FIG. 2B, the largest aggregate of the carbon black 12 in the partitioned region is denoted at 14. Denoted at xa and ya are the width dimensions of the aggregate 13, and xb and yb are the width dimensions of the aggregate 14. The state where the dispersity is higher in the surface than in the partitioned region means that at least one condition of xa>xb and ya>yb is satisfied, preferably, the both are satisfied. More preferably, at least one of the magnification of xa to xb and the magnification of ya to yb is 1.5 times or more.

Secondarily, when compared on the basis of the partitioned regions, the one having the larger maximum diameter of two or more virtual circles drawable in the part free from the conductive filler is defined as the one having low dispersity. According to this definition, the maximum diameter of the virtual circles is larger in the surface than in the cross section. In FIG. 2A, the largest virtual circle is denoted at 15, and in FIG. 2B, the largest virtual circle is denoted at 16. It can be understood from FIG. 2 that the diameter of the virtual circle 15 is larger than the diameter of the virtual circle 16. The ratio of diameter size of the virtual circles is preferably 1.5 times or more, more preferably, 2 times or more.

Although the partitioned region in the surface and the partitioned region in the cut surface are preferably located in the same position in the plane of the resistor, the comparison may be performed in partitioned regions having the same area in different positions if they are in the same resistor.

In this resistor 1, since the carbon black 12 is aggregated in the surface with the low dispersity of carbon black, as shown in FIGS. 1A and 2A, current paths are easily formed through the aggregates. Accordingly, the resistance value is low in the surface of the resistor 1, and the contact resistance value of the surface with the sliding contact 5 is thus minimized. On the other hand, since the carbon black 12 is uniformly dispersed in the inner part of the resistor 1, as shown in FIGS. 1B and 2B, the current paths among carbon blacks are dispersed, and the resistance value is thus increased.

Namely, according to this resistor 1, the resistance value of the surface can be minimized while increasing the total resistance value or without significantly reducing the total resistance value. In a variable resistor as shown in FIG. 8, thus, the total resistance value with the electrodes 3 and 4 can be increased even if the vertical (longitudinal) dimension of the resistor 1 is minimized. The change quantity of resistance value to the moving quantity in the movement of the sliding contact 5 can be also increased. Further, since the contact resistance between the resistor 1 and the sliding contact 5 can be minimized, the dispersion in the relation between the sliding position in the movement of the sliding contact 5 and the resistance value (output value) can be minimized, and a variable resistor with high resolution and high performance can be thus obtained.

The method for producing the resistor differed in dispersity of the carbon black 12 (conductive filler) between the surface and the film inner part as shown in FIGS. 1 and 2 is then described.

The resistor 1 can be produced by screen-printing a mixed solution on the substrate 2, and drying it followed by baking.

The mixed solution is a mixture of the above-mentioned polyimide resin, a solvent for dissolving the resin, and the carbon black. To produce the resistor 1, both a low-boiling point good solvent with high solubility to the resin and high volatility and a high-boiling point poor solvent lower in solubility than the good solvent and lower in volatility than the good solvent are used.

In the mixed solution used for the production of the resistor 1 shown in the TEM picture of FIG. 1, diethylene glycol monoethyl ether (H5C2OC2H4OC2H4OH; boiling point 202° C.) was used as the good solvent, and terpineol (boiling point 219° C.) was used as the poor solvent. The good solvent and the poor solvent were mixed in a mass ratio of 1:1, the mixture of both the solvent was mixed with the resin in a mass ratio of 1:1, and the carbon black was further mixed thereto in the above-mentioned ratio.

The mixed solution is pattern-formed on the surface of the substrate 2 such as ceramic substrate or glass epoxy substrate excellent in heat resistance and insulating property by means of screen printing or the like. The printed substrate is put in a drying furnace, and dried at a prescribed temperature for a prescribe time, and the solvent is vaporized by this drying to solidify the mixed solution. When it is further baked at a temperature higher than the drying temperature, the resin that is the thermosetting resin is crosslinked and hardened in a polymer state. Consequently, the resistor 1 comprising the carbon black dispersed in the inner part can be obtained.

In the drying process after printing the mixed solution, the good solvent with low boiling point vaporizes first in the surface of the film-formed mixed solvent, and the poor solvent with high boiling point is dominantly present in the surface for a long time. This poor solvent is low in solubility to the resin (binder resin), resulting in the large particle size of the resin dissolved in the mixed solution, and the deterioration of the dispersion state of carbon black. Accordingly, the dispersity of carbon black is deteriorated in the surface of the resistor 1 as shown in FIG. 1A after backing.

On the other hand, since the inner part of the film-formed mixed solution is interrupted from air, the vaporization of both the good solvent and the poor solvent is delayed, compared with in the surface, and both the solvents are present in the inner part over a long time. Accordingly, the dispersion state of the resin within the mixed solvent is improved by the action of the good solvent, and the particle size of the resin in the mixed solution is minimized to provide a satisfactory dispersion state of carbon black. Accordingly, when the mixed solution is dried by the vaporization of the poor solvent and good solvent, the carbon black is uniformly dispersed in the inner part.

Thus, at the point of time when the resin is cured by baking after drying, the dispersity of carbon black lowers in the surface of the resistor 1 as shown in FIG. 1A to reduce the resistance value, and the dispersity of carbon black increases in the inner part of the resistor 1 as shown in FIG. 1B to keep a high resistance value.

Figure 3:
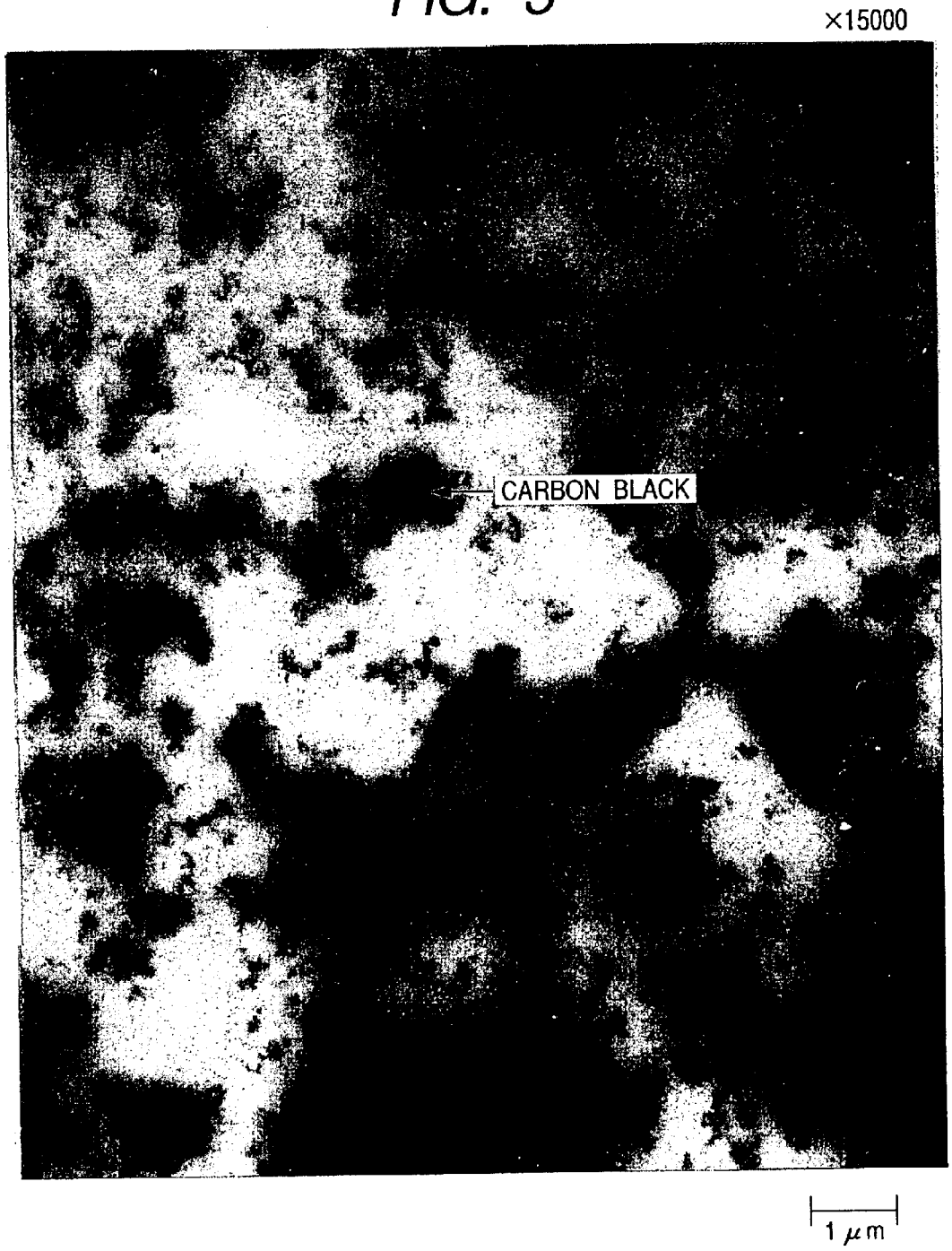
FIG. 3 is a TEM picture of a mixed solution comprising a binder resin and carbon black dissolved in a good solvent.
Figure 4:
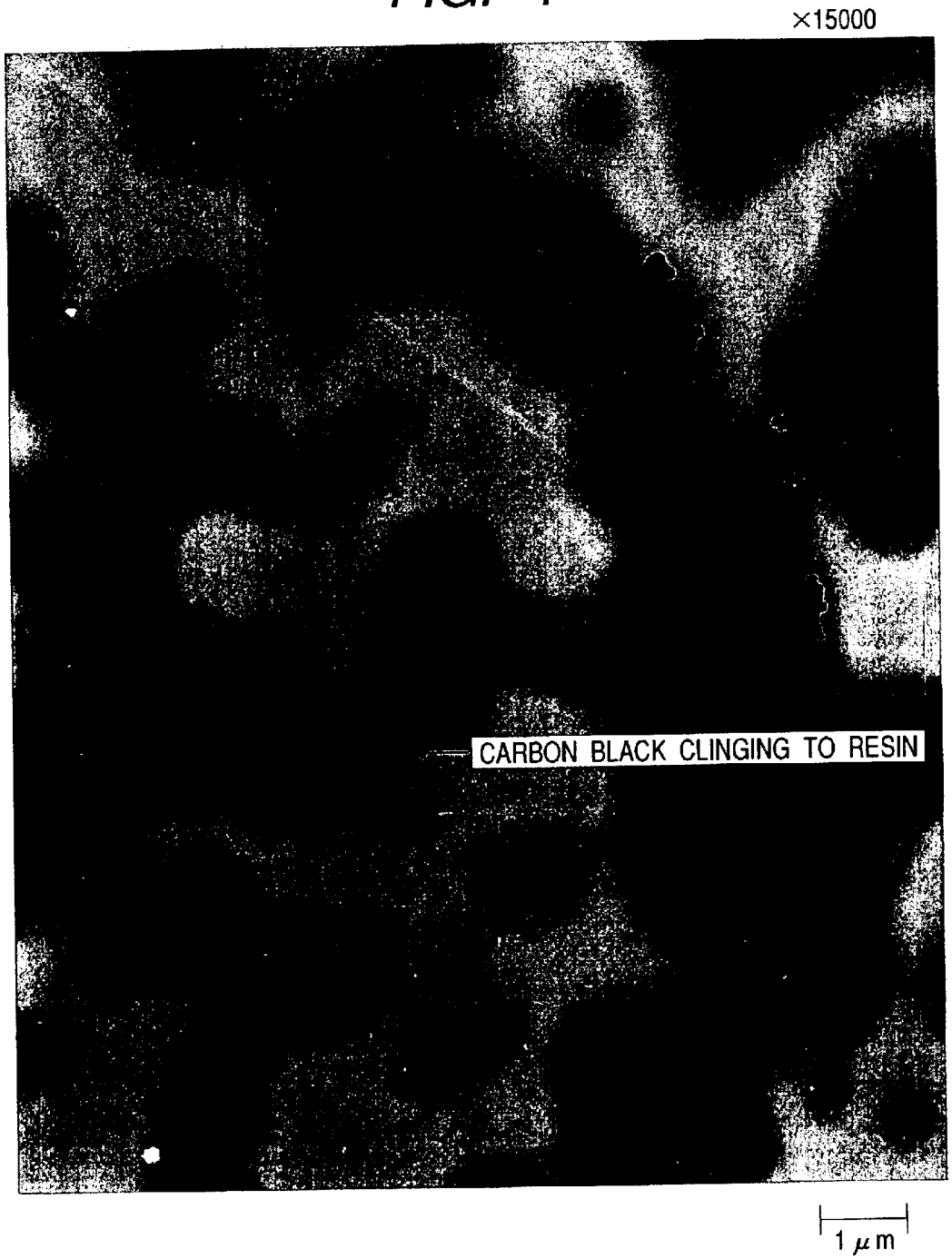
FIG. 4 is a TEM picture of a mixed solution comprising a binder resin and carbon black dissolved in a poor solvent.

The difference in the dispersing function to resin and carbon black between the good solvent and the poor solvent is described according to FIGS. 3 and 4.

FIG. 3 is a TEM picture of a mixed solution as a comparative example obtained by mixing diethylene glycol monoethyl ether (H5C2OC2H4OC2H4OH; boiling point 202° C.) that is the good solvent to the resin in a mass ratio of 1:1, and then mixing carbon black thereto, and FIG. 4 is a TEM picture of a mixed solution as another comparative example obtained by mixing terpineol that is the good solvent to the resin in a mass ratio of 1:1 and then mixing carbon black thereto.

The comparison between FIGS. 3 and 4 shows that the carbon black is uniformly dispersed with the resin in the mixed solution using only the good solvent as in FIG. 3, and the carbon black is present in an aggregated state clinging to the resin in the mixed solution using only the poor solvent as shown in FIG. 4.

The mixed use of the good solvent and the poor solvent as in the above embodiment allows a structure in which the dissolving function of the poor solvent shown in FIG. 4 is dominant in the surface of the resistor 1, and the dissolving function of the good solvent shown in FIG. 3 is dominant in the inner part.

FIG. 5 shows a further comparative example.

In the comparative example of FIG. 5, a film 10 $\mu$m thick is pattern-formed by use of a mixed solution obtained by mixing the diethylene glycol monoethyl ether shown in FIG. 3 to the resin in a mass ratio of 1:1, and then mixing the carbon black thereto, and it is dried followed by baking to obtain a resistor.

Figure 5A:
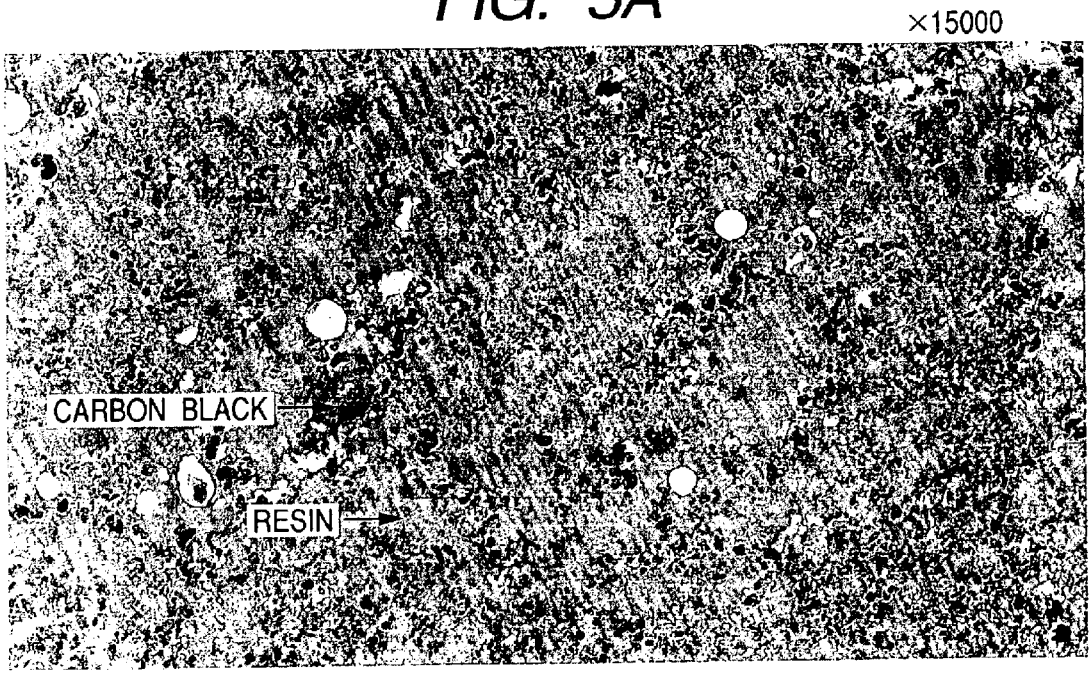
FIG. 5A is a TEM picture of the surface of the resistor and FIG. 5B is a TEM picture of an internal cross section of the resistor.
Figure 5B:
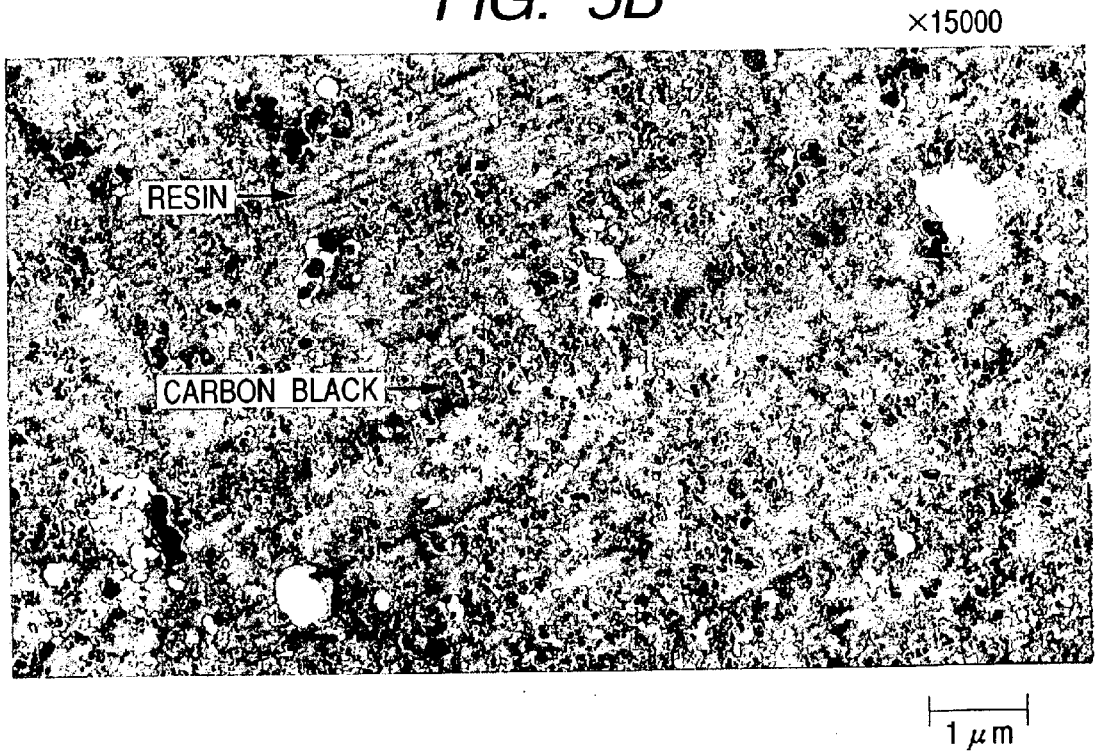

FIG. 5A is a TEM picture of the surface of the resulting resistor, and FIG. 5B is a TEM picture of the cross section thereof in the same position as in FIG. 1B. As is apparent from shown in FIG. 5, the carbon black is uniformly dispersed in both the surface and the inner part of the resistor of this comparative example, and the resistance value is high in both the surface and inner part. Accordingly, in a variable resistor using the resistor shown in FIG. 5, the maximum resistance value can be increased, but the contact resistance with the sliding contact is also increased.

As the good solvent, any alcohol-based or ether-based low-boiling point solvent having a boiling point ranging from 190° C. to 210° C. is usable. The above-mentioned diethylene glycol monoethyl ether, dipropylene glycol monomethyl ether (H3COC3H6OC3H6OH; boiling point 190° C.), diethylene glycol monomethyl ether (H3COC2H4OC2H4OH; boiling point 194° C.), and dipropylene glycol monoethyl ether (H5C2OC3H6OC3H6OH; boiling point 198° C.) are usable alone or in combination of two or more thereof.

As the poor solvent, any alcohol based high-boiling point solvent having a cyclic alkyl or aromatic ring which has a boiling point of 215° C. or higher is usable. The above-mentioned terpineol, 2-phenoxy ethanol (boiling point 245° C.), and 2-benzyloxy ethanol (boiling point 256° C.) are usable alone or in combination of two or more thereof.

The terpineol has the following chemical formula:

[Chemical formula 1]

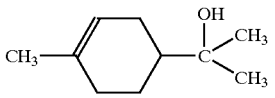

The 2-phenoxy ethanol has the following chemical formula:

[Chemical formula 2]

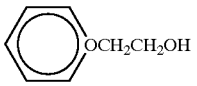

The 2-benzyloxy ethanol has the following chemical formula:

[Chemical formula 3]

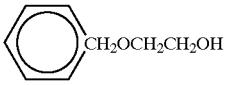

The combination of the good solvent and the poor solvent may be optionally selected. The temperature difference in boiling point between the poor solvent and the good solvent is preferably within the range of 15 to 30° C. The temperature in the drying process is preferably higher than the boiling point of the good solvent and lower than the boiling point of the poor solvent.

In the present invention, in addition to carbon black, graphite and other carbon fibers, and mixed bodies thereof can be used as the conductive filler.

EXAMPLE

The resistor shown in FIGS. 1A and B is taken as a working example, and the resistor shown in FIGS. 5A and 5B which is formed by use of only the good solvent shown in FIG. 3 is taken as a comparative example.

The linear sliding type variable resistor shown in FIG. 8 was manufactured by use of the resistor of the working example and the resistor of the comparative example. In both the working example and the comparative example, the thickness of the resistor was set to 10 μm, and the plane shape was set to a vertical (longitudinal) dimension of 12 mm and a width dimension of 2.7 mm.

In the production of the resistor of the working example, as shown in FIG. 6, the temperature in the drying process was set to 170° C., 190° C., 200° C., 210° C., and 220° C., and the drying time at the respective temperature was set to 10, 7 and 5 minutes. In the baking process after drying, the baking temperature was set to 380° C., and the time to 100 minutes.

In the production of the resistor of the comparative example, as shown in FIG. 7, the temperature in the drying process was set to 160° C., 170° C., 180° C., 190° C., 200° C., 210° C., 220° C., 230° C., 240° C., and 250° C., and the drying time at the respective temperature was set to 10, 7, and 5 minutes. In the baking process after drying, the baking temperature was set to 380° C., and the time to 100 minutes similarly to the working example.

Figure 6A:
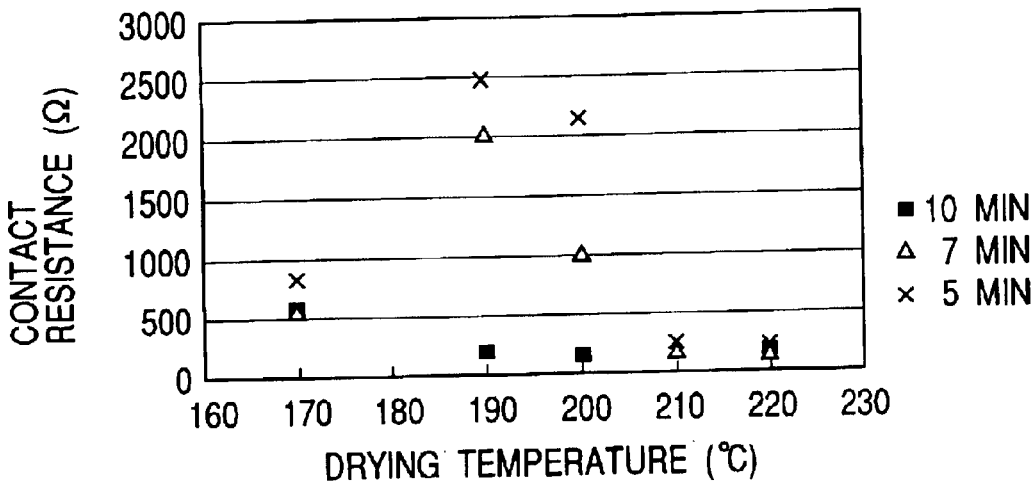
FIG. 6A shows the measurement value of contact resistance in the working example.
Figure 6B:
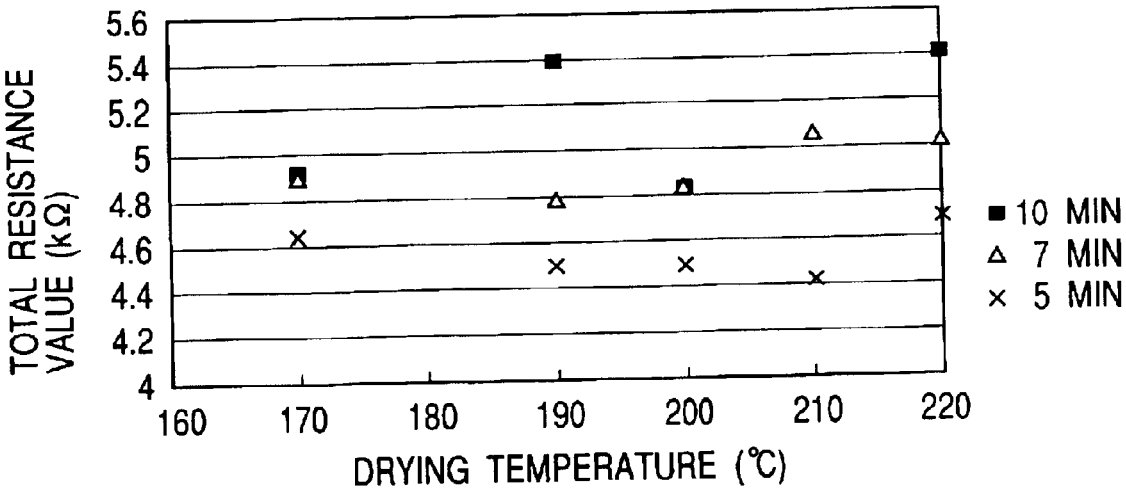
FIG. 6B shows the measurement value of total resistance value in the working example.

FIG. 6A shows the contact resistance (Ω) of each resistor based on the working example with the sliding contact, and FIG. 6B shows the total resistance value (kΩ) of the resistor based on the working example with the electrodes 3 and 4.

Figure 7A:
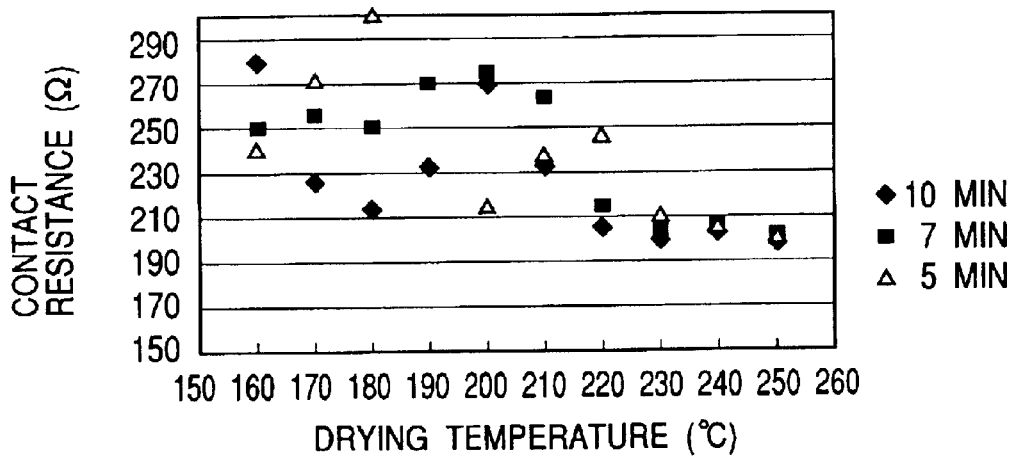
FIG. 7A shows the measurement value of contact resistance in the comparative example.
Figure 7B:
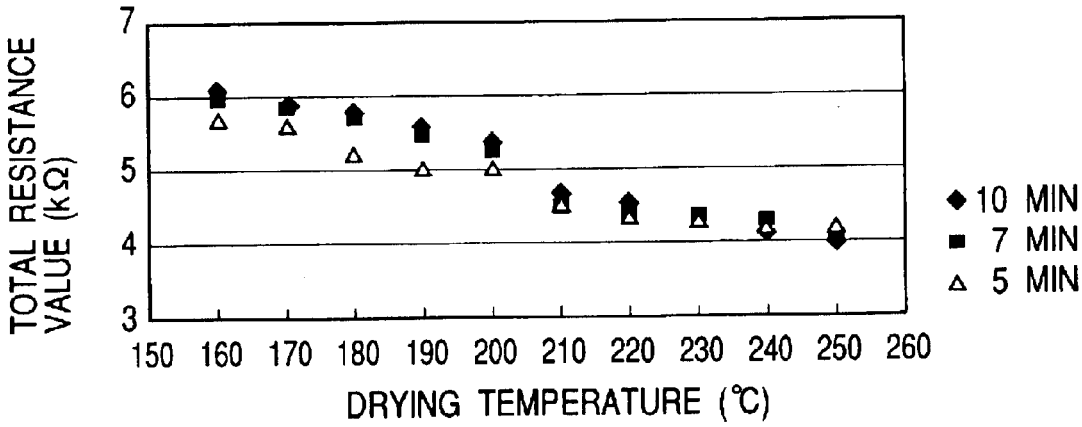
FIG. 7B shows the measurement value of total resistance value in the comparative example.

FIG. 7A shows the contact resistance (Ω) of each resistor based on the comparative example with the sliding contact, and FIG. 7B shows the total resistance value (kΩ) of the resistor based on the comparative example with the electrodes 3 and 4.

In the measurement of the contact resistance, the sliding element 5 is formed of a phosphor bronze plate having a silver-plated surface, and the contact part 5*a* of the sliding contact 5 is formed so as to be capable of crossing the whole length of the width dimension of 2.7 mm.

The sliding contact 5 is slid at a speed of 20 mm/sec, and at this time, DC 5V is applied to the electrodes 3 and 4 from a DC power supply circuit 21, so that a constant current 10 (1 mA) is carried to the resistor 1 and the sliding contact 5. The voltage between the electrode 3 and the sliding contact 5 is measured when the sliding contact 5 is slid on the resistor 1, the change of resistance value is read from this voltage and the current I0, and the resistance value of the resistor 1 (the resistance value of the resistor 1 from the electrode 3 to the sliding contact 5) and the resistance value of the sliding contact 5 at respective points of time are subtracted to obtain the contact resistance (Ω) The maximum value of the contact resistance in the sliding of the sliding contact 5 is plotted in FIGS. 6A and 7A.

It is found from FIG. 6 that, in the working example, the contact resistance can be minimized, and the total resistance can be kept large if the drying time is 5 minutes or more and the drying temperature is not higher than the boiling point of the good solvent and not lower than the boiling point of the poor solvent, preferably, the vicinity of the intermediate temperature between the boiling points of both the solvents.

On the other hand, it is found from FIG. 7 that, in the comparative example, the contact resistance can be minimized by increasing the drying temperature, but the total resistance value is also minimized.

According to the present invention as above, the contact resistance of the surface of the resistor with the sliding contact or contact member can be reduced, and the total resistance can be also prevented from significantly lowering. Thus, the resistance value of the resistor can be precisely read.

What is clamed is:

1. A method for producing a resistor comprising:

a process for printing, in a prescribed pattern, a mixed solution containing a good solvent having high solubility to a binder resin, a poor solvent lower insolubility than the good solvent and lower in volatility than to good solvent, a thermosetting binder resin, and a conductive filter:

a process for drying the mixed solution; and a process for curing the binder resin by baking, wherein the good solvent is at least one selected from dipropylene glycol monomethyl ether, diethylene glycol monomethyl ether, and dipropylene glycol monoethyl ether, and wherein the poor solvent is at least one selected from terpineol, 2-phenoxy ethanol, and 2-benzyloxy ethanol.

2. The method for producing a resistor according to claim 1, wherein the drying process is carded out at a temperature higher than the boiling point of the good solvent and lower than the boiling point of the poor solvent.

* * * * *